US012196071B2

(12) United States Patent
Nash

(10) Patent No.: US 12,196,071 B2
(45) Date of Patent: Jan. 14, 2025

(54) DOWNHOLE RATCHET AND METHOD TO STABILIZE TORSIONAL ENERGY WITHIN A DRILLING STRING IN RESPONSE TO SLIP-STICK

(71) Applicant: Kenneth L Nash, Cypress, TX (US)

(72) Inventor: Kenneth L Nash, Cypress, TX (US)

( * ) Notice: Subject to any disclaimer, the term of this patent is extended or adjusted under 35 U.S.C. 154(b) by 0 days.

(21) Appl. No.: 18/107,717

(22) Filed: Feb. 9, 2023

(65) Prior Publication Data

US 2023/0184083 A1 Jun. 15, 2023

Related U.S. Application Data

(63) Continuation-in-part of application No. 17/058,839, filed as application No. PCT/US2019/034325 on May 29, 2019, now Pat. No. 11,603,752.

(60) Provisional application No. 62/821,006, filed on Mar. 20, 2019, provisional application No. 62/689,430, filed on Jun. 25, 2018, provisional application No. 62/683,226, filed on Jun. 11, 2018, provisional application No. 62/677,955, filed on May 30, 2018.

(51) Int. Cl.
*E21B 44/04* (2006.01)
*E21B 17/07* (2006.01)

(52) U.S. Cl.
CPC ..... *E21B 44/04* (2013.01); *E21B 17/07* (2013.01)

(58) Field of Classification Search
CPC ..... E21B 44/04; E21B 7/04; E21B 17/1078; E21B 17/05
See application file for complete search history.

(56) References Cited

U.S. PATENT DOCUMENTS 6,082,457 A * 7/2000 Best ..... E21B 17/05 166/301
6,241,032 B1 * 6/2001 Falgout, Sr. ..... E21B 21/10 192/30 W
2005/0183892 A1 * 8/2005 Oldham ..... E21B 7/20 175/402
2005/0211473 A1 9/2005 Zupanick

FOREIGN PATENT DOCUMENTS

WO 2004109052 12/2004

* cited by examiner

*Primary Examiner* — Dany E Akakpo
(74) *Attorney, Agent, or Firm* — Kenneth L. Nash; Thomas D. Nash

(57) ABSTRACT

A downhole ratchet is utilized between tubulars in the drill string to reduce torsion energy in the drill string. A first gear and a second gear are biased into engagement to drive the drill string below the position of the downhole ratchet in the drill string during normal drilling. The downhole ratchet is constructed to release between the first gear and second gear when the tubular below the ratchet spins faster than the tubular above the ratchet due to slip-stick. Once the tubular below spins more slowly or at the same speed then the ratchet mechanism locks the upper and lower tubulars together to rotate the bit. The effect is to release torsional energy in the drill string to reduce slip stick oscillations.

20 Claims, 3 Drawing Sheets

DOWNHOLE RATCHET AND METHOD TO STABILIZE TORSIONAL ENERGY WITHIN A DRILLING STRING IN RESPONSE TO SLIP-STICK

BACKGROUND OF THE INVENTION

Field of the Invention

The present invention relates generally to a downhole ratchet for a drill string that allows torsional energy in the drill string to be released.

Description of the Background

Slip-stick (stick-slip) can begin when the bit grabs the formation. The drilling string continues to rotate and build torsional energy in the drilling string. The bit then releases. Due to the additional torsional energy in the drilling string due to slip-stick, oscillations of slowing and speeding of the drill bit can occur. Full blown slip-stick results in the bit actually stopping. When the bit is released, the bit begins spinning at high speeds sometimes much higher than the drilling speed. The oscillation can continue indefinitely. Even at much lesser variations below full blown slip-stick, the drill string actually shortens and lengthens, which produces changes in the axial length of the drill string. The shortening and lengthening of the drill string can cause poor cutting and damage to the bits.

Slip-stick is a problem that damages the bits as they are bounced up and down on the bottom of the wellbore which can be due to actual shortening and lengthening of the drill string (bit bounce), slowing drilling due to poor cutting during Slip-stick, increasing the number of bit trips, damaging the wellbore, causing an irregular well bore, causing circulation problems, decreasing the control of the direction of drilling, decreased cementing reliability due to the presence of one or more elongated troughs, clearance problems for gravel packing screens and other problems.

In some cases, full blown stick-slip at the lower portion of the drill string miles below the surface especially in higher angle holes or deeper holes is not readily detectable with surface sensors. Therefore surface controls to vary drilling speed to counteract the stick-slip may not be effective.

Because modern PDC cutting elements of bits have a very short length and must be held in constant close contact for maximum cutting effect, even small axial changes in the length of the drill string can significantly impede drilling progress. Bit bounce can increase bit wear and require more frequent bit trips. Bit bounce also damages the well bore.

Whenever the drill bit is rotated for drilling into a formation, the drill string has torsional windup or torsional potential energy, just as a torsional spring might have when torque is applied thereto. When drilling, it is highly desirable that this torsional windup or potential energy be a constant value based on the torsional constant of the drill string, and not a varying or oscillating amount, which occurs with slip-stick.

The irregular drilling due to slip-stick damages the drilling string and damages the wellbore. Torsional vibrations may produce a twisted borehole that becomes the source for additional torque. Thus, the problem of torsional vibrations is self-reinforcing. For many reasons, it is desirable to drill a straighter hole with reduced spiraling effects along the desired drilling path.

For instance, it has been found that tortuosity, or spiraling effects frequently produced in the wellbore during drilling, is associated with degraded bit performance, forward and reverse bit whirl, an increased number of drill string trips, increased likelihood of losing equipment in the hole, increased circulation and mud problems due to the troughs along the spiraled wellbore, increased stabilizer wear, decreased control of the direction of drilling, decreased cementing reliability due to the presence of one or more elongated troughs, clearance problems for gravel packing screens, decreased ROP (rate or speed of drilling penetration), degraded logging tool response due to hole variations including washouts and invasion, decreased reliability of MWD (measurement while drilling) and LWD (logging while drilling) due to the vibrations generally associated therewith, and many other problems.

It would be desirable to maintain torsional potential energy at a constant value. This maintains the constant close contact of the drill bit with the surface to be cut for maximum cutting effects. It would be desirable to provide a tool that would stabilize torsional potential energy within a few cycles.

While systems that use surface controls to balance torsional potential energy are to some extent effective, they are limited in that energy variations must travel all the way to the surface to even be detected. The deeper the well, the higher the drilling angle, the less likely this is to occur which limits usefulness of surface controls.

Consequently, there remains a need to provide an improved downhole assembly to perform this function and keep the torsional potential energy of the drill string constant. It would be desirable to provide a tool that would drain energy from the drill string when the drill bit turns faster than the drilling rate but then immediately apply driving energy to the drill bit when the bit drops back to the drilling driving rate velocity rate. This effect would quickly stabilize the bit drilling speed, maximize bit life, maximize drill sting life, and improve the hole. It would be desirable that the tool be relatively inexpensive and simple. Those of skill in the art will appreciate the present invention which addresses the above problems.

SUMMARY OF THE INVENTION

Accordingly, it is an objective of the present invention to provide an improved drilling assembly and method.

Another objective of one embodiment of the present invention is to decay torsional pulses going up the drill string to stabilize torsional potential energy in the drill string.

Another objective of the present invention is to release the lower portion of a drillstring to stabilize torsional potential energy in the drillstring.

Another objective of the present invention is to limit axial lengthening/shortening oscillation of the drill string to the point where bit bounce is eliminated—for longer bit life and improved positioning of the PDC cutters to maximize drilling rate.

An objective is to provide faster drilling ROP (rate of penetration), longer bit life, and reduced stress applied to the drill string.

A feature of the present invention is a ratchet that allows the drill string below the ratchet to spin to release torsional energy and then drives the drill string as soon as it slows down.

An advantage of use of the present invention in the drillstring is faster drilling ROP (rate of penetration), longer bit life and reduced stress applied to the drill string.

Other examples of advantages include but are not limited to reduced stress on drill string joints, truer gauge borehole, improved circulation, improved cementing, improved lower noise MWD and LWD, improved wireline logging accuracy, improved screen assembly running and installation, fewer bit trips, reduced or elimination of tortuosity, reduced or elimination of drill string buckling, reduced hole washout, improved safety, and/or other benefits.

These and other objectives, features, and advantages of the present invention will become apparent from the drawings, the descriptions given herein, and the appended claims. However, it will be understood that the above-listed objectives, features, and advantages of the invention are intended only as an aid in understanding aspects of the invention, and are not intended to limit the invention in any way, and therefore do not form a comprehensive or restrictive list of objectives, and/or features, definitions, and/or advantages of the invention.

One general aspect includes a downhole ratchet connectable in a drilling string to release torsional energy from the drilling string when drilling a wellbore. The downhole ratchet also includes a first gear mounted to rotate with the first tubular; a second gear mounted to rotate with the second tubular, and a bias member that urges gear engagement between the first gear and the second gear.

Implementations may include one or more of the following features. The downhole ratchet may include a rotating connection between the first tubular and the second tubular. The rotating connection is operable to support a weight of the drilling string below a downhole position of the downhole ratchet. The downhole ratchet may include a housing with the first gear being slidingly mounted with respect to the housing. The bias member urges the first gear into sliding engagement the second gear. The downhole ratchet is operable without electronics.

One general aspect includes a downhole ratchet connectable in a drilling string to release torsional energy from the drilling string when drilling a wellbore. The downhole ratchet also includes a first gear mounted to rotate with the first tubular; a second gear mounted to rotate with the second tubular, and a rotating connection that permits rotation between the first tubular and the second tubular.

Implementations may include one or more of the following features. The downhole ratchet where the rotating connection is operable to support a weight of the drilling string below a downhole position of the downhole ratchet in the drilling string. The downhole ratchet may include a bias member that urges gear engagement between the first gear and the second gear. The downhole ratchet may include a housing, the first gear being slidingly mounted with respect to the housing. The bias member urges the first gear into the second gear. The downhole ratchet is operable without electronics.

One general aspect includes a downhole ratchet connectable in a drilling string to release torsional energy from the drilling string when drilling a wellbore. The downhole ratchet also includes a first component, a first threaded connection on the first component, the first threaded connection being threadably connectable with the first tubular. The ratchet also includes a second component mounted for rotation with respect to the first component, a second threaded connection on the second component, the second threaded connection being threadably connectable with the second tubular. The ratchet also includes the first component and the second component may include a mechanical arrangement that locks the first tubular and the second tubular together for drilling, the mechanical arrangement releasing the first tubular with respect to the second tubular to release torsional energy from the drilling string. The ratchet also includes the mechanical arrangement being operable without requiring electronics.

Implementations may include one or more of the following features. The downhole ratchet where the mechanical arrangement further may include a first gear mounted to rotate with the first tubular, and a second gear mounted to rotate with the second tubular. The mechanical arrangement further may include a bias member that urges gear engagement between the first gear and the second gear. The downhole ratchet wherein the mechanical arrangement further may include a housing, the first gear, the second gear, and the bias member being mounted in the housing. The mechanical arrangement further may include a rotating connection between the first gear and the second gear. The rotating connection is operable to support a weight of the drilling string below a downhole position of the downhole ratchet in the drilling string.

One general aspect includes a ratchet connectable in a drilling string to release torsional energy from said drilling string when drilling a wellbore, said drilling string extending from the surface to a drill bit, said ratchet being connectable between a first tubular and a second tubular in said drilling string, said ratchet including: a body; a first threaded connection on said body, said first threaded connection being threadably connectable with said first tubular; a first component mounted for rotation with respect to said body, a second threaded connection on said first component, said second threaded connection being threadably connectable with said second tubular; and a second component, said first component and said second component being mechanically linked to lock said first and second tubulars together when said second tubular rotates at a velocity equal to or less than said first tubular, and permit relative rotation between said first and second tubulars when said second tubular rotates at a velocity greater than said first tubular to thereby release torsional energy from said drilling string.

By gear the meaning would specifically include a toothed wheel as an example, However, the more general meaning is intended that gears are defined as mechanical components that transmit/control rotation and power transfer from one shaft to another. In this case, the two shafts are the drill pipe above and below the downhole ratchet. There are many known mechanisms for ratchets. For example, a hinged tooth is considered a gear when arranged to control power transfer between the two pipes. A pipe gripping mechanism can be a gear to transmit power. Other shapes of gears, teeth arrangement, gripping/releasing components and mechanisms, and the like are possible. It will be appreciated from the drawings below by one of skill that the downhole ratchet is purely mechanical and works without need of sensors or other downhole electronics to control operation.

DETAILED DESCRIPTION

Figure 1:
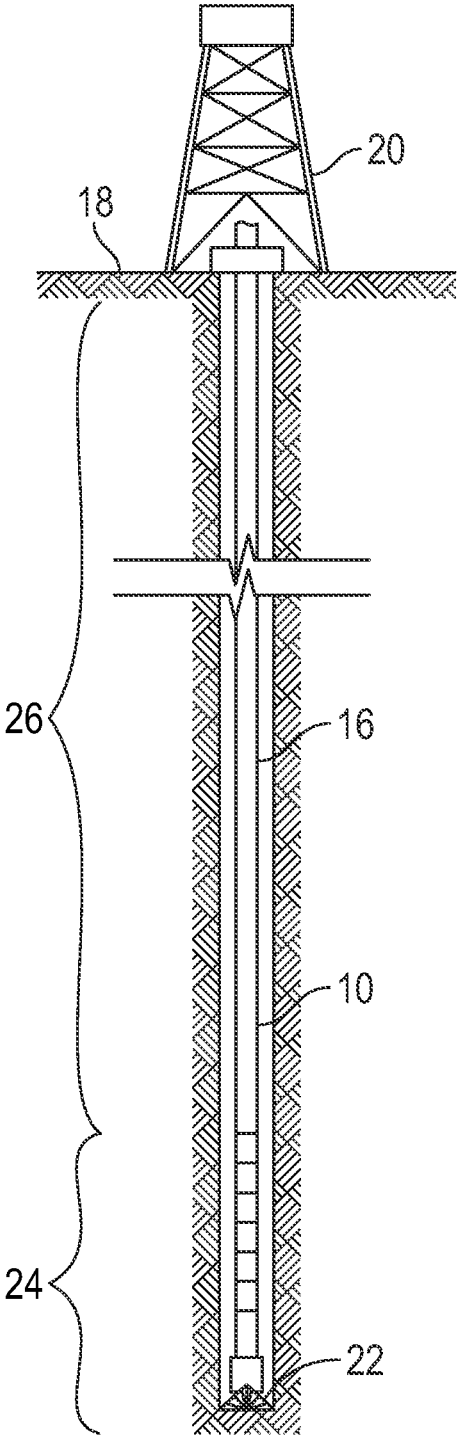
FIG. 1 discloses a drill string and one or more downhole ratchets located at selected positions in the drill string in accord with one possible embodiment of the invention, FIG. 2 discloses a ratchet mounted in the drill string between a first tubular, which may be an upper tubular, and a second tubular, which may be a lower tubular in the drill string in accord with one possible embodiment of the invention.
Figure 2:
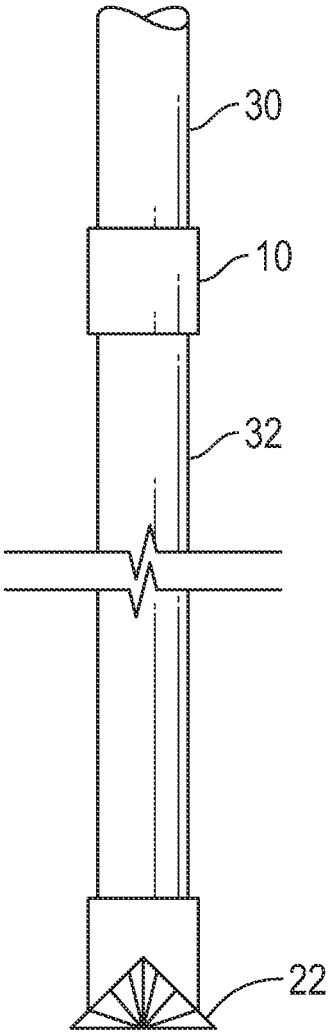

FIG. 1 shows a drill string 16 in which ratchet 10 could be mounted at a downhole position in the drilling string as shown in FIG. 1 and FIG. 2. Slip mechanisms may also be referred to herein as ratchet mechanisms or the like. The drill string 16 extends from an earth surface 18 to the drill bit 22. Surface drive 20 applies torque to rotate the drill sting to rotate the bit. Alternatively, or in addition, the bit 22 may be driven by a downhole motor.

The drill string 16 comprises a bottom hole assembly (BHA) 24 and a pipe string 26. The pipe string may also be referred to as a drill pipe portion or other related terminology. The BHA 24 is at a lowermost position in the drill string 16. The BHA 24 comprises a bit and components such as a bit sub, drill collar, heavyweight drill collar, heavy weight drill pipe, stabilizer, reamer, shock, hole opener, downhole motor, rotary steerable system, directional equipment, drilling while measurement equipment, steering unit, near bit inclination, and/or non-magnetic drill collar. While in FIG. 1 a top drive or rotary table drive on the surface is utilized to rotate the drill string, many wells are drilled with a downhole motor instead of the top/rotary drive or in addition therewith.

The BHA is connected to the drill pipe portion 26 of the drillstring. The drill pipe portion 26 comprises additional components such as drill pipe, coiled tubing, heavyweight drill pipe, and/or stabilizer. The drill pipe portion 26 of the drill string is typically much longer than the BHA. Where the BHA may typically be in the range of 100 to 400 feet, the drill pipe portion 26 of the drill string may be several miles long.

During normal drilling, the slip mechanism 10 operates the same as other tubulars in the drill string to convey power from the top drive to the drill bit. When Slip-stick occurs so that the drill bit sticks and then comes loose, the bit accelerates to a higher rotation velocity than the drill string velocity driven by the top drive, rotary table or downhole motor. At this time, the slip mechanism 10 allows the tubulars below to rotate independently with respect to the tubular above.

Figure 3:
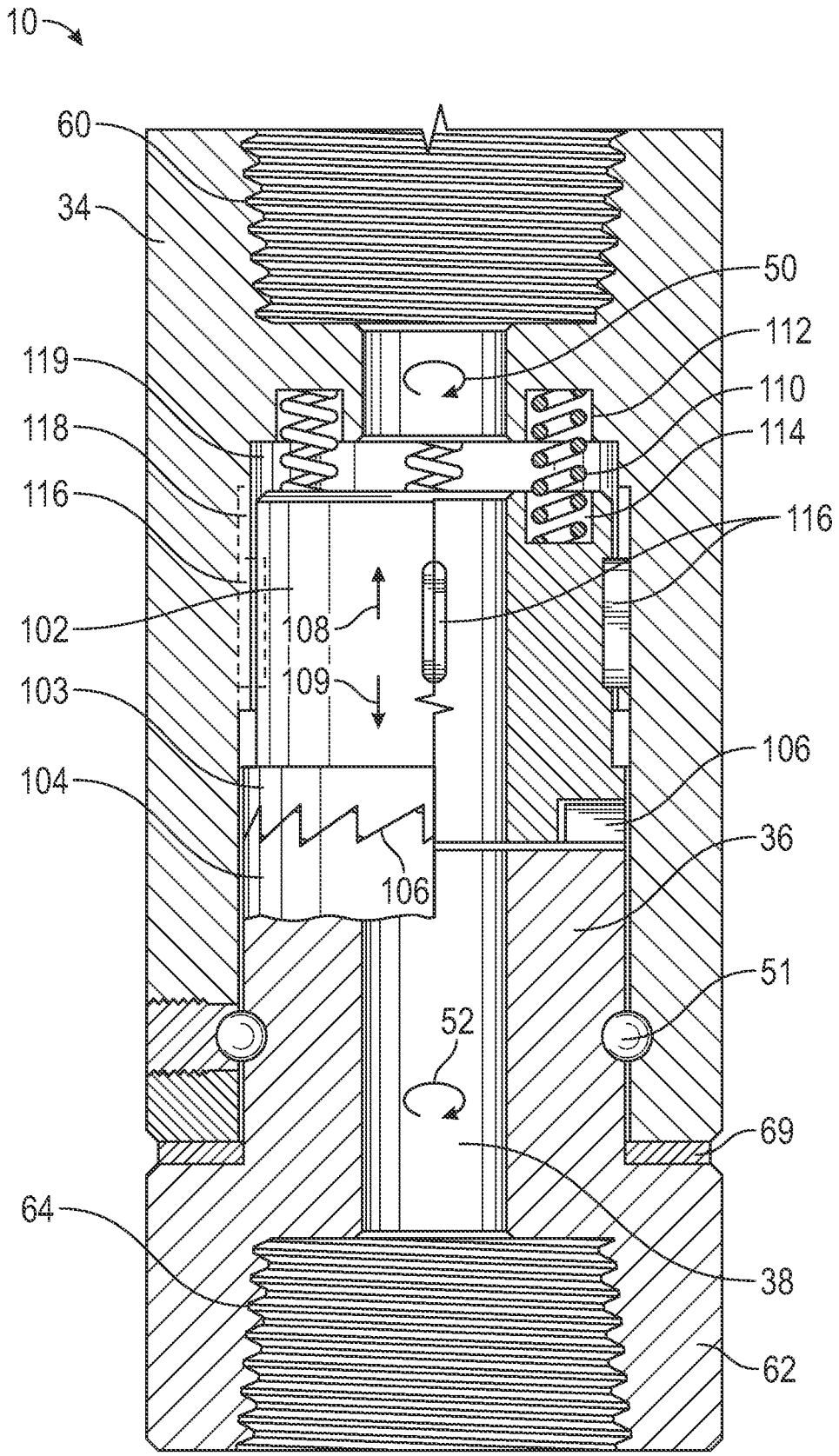
FIG. 3 is an elevational view, partially in cross-section, of a downhole ratchet showing a vertical cross-section extent thereof in accord with one possible embodiment of the present invention.

FIG. 3 shows slip mechanism 10, a mechanical arrangement that creates a type of downhole ratchet, that comprises slidably mounted upper gear 102, 103 and lower gear 104 that grip upper tubular 30 (FIG. 2) and lower tubular 32 (FIG. 2) and allow/prevent rotation. As explained previously, slippage depends on the relative velocity of outer body 34 and inner body 36 and lower portion 62 thereof as indicated by rotational arrows 50, 52. Outer body 34 and inner body 36 form a housing in which the upper 102, 103 and lower gears 104 are mounted. A flow path 38 is provided that extends through 10. Ball type bearings 51 are utilized to connect upper tubular to outer body 34 to inner body 36. Other types of rotating connections can be used. Thrust bearing 69 provides a bearing for downward weight so that the rotating connection is operable to support the weight of the drill string below the downhole position in the drill string where the downhole ratchet is mounted. When the velocity of lower tubular 32 (secured to threaded connection 64) is faster than upper tubular 30 (secured to threaded connection 60) then upper gear 102 is pushed upwardly as indicated by arrow 108 against the bias provided by bias members such as, for example, springs 110. Springs 110 push gears 103 and 104 into gear engagement for normal drilling. Springs 110 are mounted in pockets such as pocket 112 in outer body 34 and in pocket 114 in moveable gear 103. Note that connectors 60 and 64 may be male or female and more typically connector 60 is female and connector 64 is male. When the velocity of lower tubular 32 is less than or equal to upper tubular 30 then upper gear 102 moves downward due to the bias as indicated by arrow 109. Upper gear 102 cannot rotate with respect to outer body 34 due to splines 116 that engage corresponding grooves 118 shown in dash. Thus, one of skill looking at FIG. 3 will appreciate that upper gear is mounted to be slidably moveable with respect to the housing and specifically outer body 34. In other words, the first gear is slidingly mounted with respect to the housing and specifically outer body 34.

It will be appreciated for the claims that the terms first component and second component are for convenience and that either of the inner or outer body could be called a first component or second component. The inner body or outer body may also be referred to as an inner tubular or outer tubular. One of skill reviewing FIG. 3 will appreciate that an advantage of the downhole ratchet 10 is that it operates without requiring electronics such as a downhole sensor to monitor rotation and/or rotational speed. One of skill is aware that a ratchet does not require and does not need a downhole sensor such as a rotational speed sensor and/or downhole electronics as indicated by FIG. 3 (which clearly does not show or require this feature).

One advantage of downhole ratchet 10 is that very few moving parts are required. The drive force to rotate the bit is transmitted by teeth 106 on the two opposing gears.

Accordingly, the upper gear 102 moves up and down in the pocket 119. However upper gear 102 is biased downwardly. It will be appreciated that many types of springs may be utilized instead of coil springs as shown. Outer body 34 is secured to the upper tubular 30 via threaded connection 60. The upper gear 102 has to rotate with the outer body 34 because the pocket 119 comprises splines 116. Because outer body 34 is threadably secured to the upper tubular 30, upper gear 102 is constrained to rotate with the upper tubular 30.

The lower gear 104 connects to the lower tubular 32 through threaded connection 64. The lower gear 104 cannot move axially up and down. During normal drilling, the upper gear 102 drives the lower gear 104, which drives the drill string below the slip mechanism 10.

If due to slip stick, lower gear 104 rotates faster than the upper gear 102 then the spring loaded upper gear 102 is pushed up and slipping occurs between upper gear 102 and lower gear 104 until the velocity of lower gear 104 drops to the driving speed of outer body 34.

This releases torque energy in the drill string to dampen out torque oscillations. Thus, one of skill when viewing the figures will appreciate that said mechanical arrangement of the downhore ratchet 10 allows the upper tubular 30 to rotate with respect to said lower tubular 32 (See also FIG. 1 and FIG. 2) to release torsional energy from said drilling string.

In other words, two saw-toothed gears 102/103, 104 with at least one gear 102 being spring loaded to press against each other with the toothed sides together. Rotating in one direction, the saw teeth of the drive disc lock with the teeth of the driven disc, making it rotate at the same speed. If the drive disc slows down or stops rotating, the teeth of the driven disc slip over the drive disc teeth and continue rotating.

Figure 4:
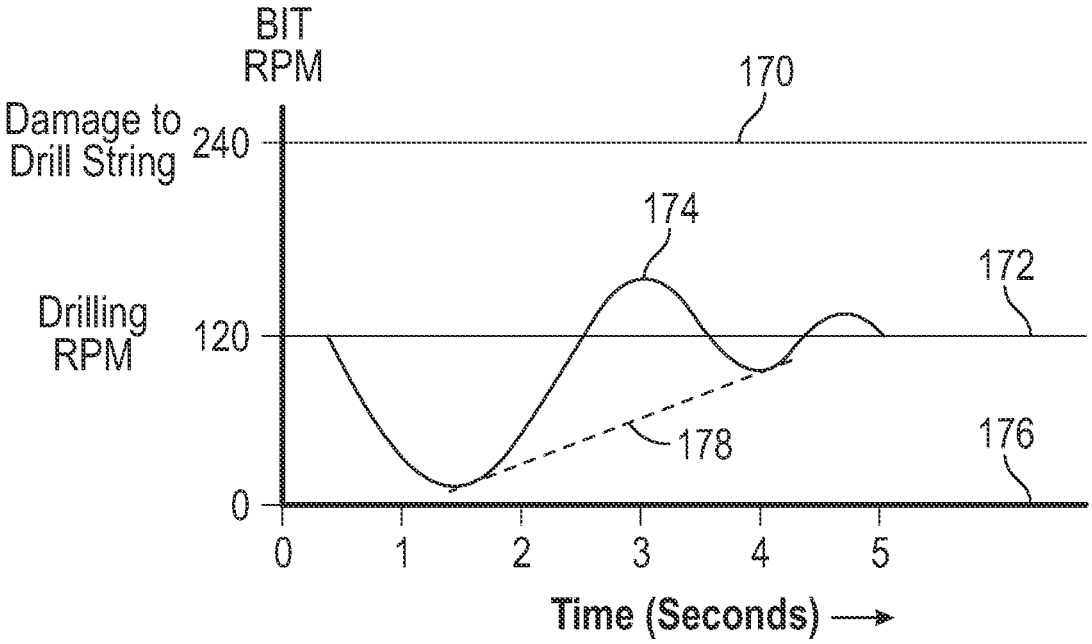
FIG. 4 shows damping of torsional oscillations resulting from placement of a slip mechanism at a first position in a drill string.

FIG. 4 shows the effect of damping of torsional vibrations in bit speed 174 (which may be closely related to the speed measured at lower tubular 32 or speed of inner body 36). Drilling speed 172 may be in the range of 120 RPM or so. The speed at which damage occurs in the drill string is shown at 170, which may be in the range of 240 RPM. Speed indicted at 176 could be in the range of zero RPM if full blown slip-stick is occurring.

As discussed, a type of slip system utilized herein is purely mechanical and may be referred to herein as purely mechanical slip systems, ratchet, or the like. This slip apparatus is connectable between an upper tubular and a lower tubular in the drilling string. This slip system utilizes components that are mechanically linked to lock upper and lower tubulars together when said lower tubular rotates at a velocity equal to or less than said upper tubular, and permit relative rotation between said upper and lower tubulars when said lower tubular rotates at a velocity greater than said upper tubular to thereby release torsional energy from said drilling string.

Many additional changes in the details, components, steps, and organization of the system, herein described and illustrated to explain the nature of the invention, may be made by those skilled in the art within the principle and scope of the invention. It is therefore understood that within the scope of the appended claims, the invention may be practiced otherwise than as specifically described.

It would be desirable to maintain torsional potential energy at a constant value. This maintains the constant close contact of the drill bit with the surface to be cut for maximum cutting effects. It would be desirable to provide a tool that would stabilize torsional potential energy within a few cycles back to a constant level.

Location of the ratchet can be accomplished in different ways. In one embodiment, one or more ratchets can be distributed through regions of the drill string. Torque and drag programs, which are commonly used in calculating dynamics of drill strings, are then used to determine how best to locate the one or more ratchets to control damping. Torque and drag problems are very common during drilling, completion and workover operations. A torque and drag module can be used to calculate torque and drag of the drill string during planning, drilling, and post-drilling. Various models for the drill string may be utilized. 3D visualization may be provided. The wellbore friction, torque and drag, between the drill string and the wellbore wall is the most critical issue which limits the drilling industry to go beyond a certain measured depth. Surface torque is defined as the moment required for rotating the entire drill string and the bit on the bottom of the hole. Torque and drag software can be utilized to model slip stick with simulated sticking loads. In this way, software can be used to determine where and how many ratchets to utilize in the drilling string. The software can determine how much torsional energy will be released from a ratchet.

Torque twists drill pipe faster than thick walled pipe. A ratchet or multiple ratchets may be positioned above the bottom hole assembly in drill pipe that twists more readily than the bottom hole assembly to be more sensitive to rotation. In one embodiment, the ratchets may be positioned every three or four pipes.

Another non-limiting feature of the present invention is to select one or more positions in the drill string for a slip/release mechanism, which releases/grabs purely mechanically without electronic or hydraulic controls, where the positions are used to adjust an amount of damping of the torsional oscillation.

A method for controlling an amount of damping of torsional oscillations in a drill string utilizing a slip system, said method comprising the steps of:

utilizing a processor to make torque and drag calculations on said drillstring, said drillstring comprising a BHA (bottom hole assembly) and a drill pipe portion;

said BHA being at a lowermost position in said drillstring, said BHA comprising a bit and components comprising one or more of a bit sub, drill collar, heavyweight drill collar, heavy weight drill pipe, stabilizer, reamer, shock, hole opener, downhole motor, rotary steerable system, directional equipment, drilling while measurement equipment, steering unit, near bit inclination, non-magnetic drill collar, said BHA being connected to said drill pipe portion of said drillstring, said drill pipe portion comprising additional of said components comprising one or more of a drill pipe, coiled tubing, heavyweight drill pipe, stabilizer; and utilizing said torque and drag calculations on said drillstring for determining one or more positions for one or more slip systems from a plurality of different positions in said drillstring to control said amount of damping of torsional oscillations in said drillstring.

In a presently preferred embodiment, at least one ratchet is positioned one or more pipe joints above the bottom hole assembly, and perhaps as many as ten joints, depending on how much rotation is expected. However, one every two or three joints above the bottom hole assembly may be effective in another embodiment.

It will be understood that the ratchet assembly may be used with rotary tables and downhole motors.

Another objective is to release the lower portion of a drillstring to stabilize torsional potential energy of said drillstring.

Another objective is to limit axial lengthening/shortening of the drill string to the point where bit bounce is eliminated—for longer bit life and improved positioning of the PDC cutters to maximize drilling rate.

A system for drilling a straight hole in with respect to a perpendicular axis of a surface of earth or a low angle hole less than fifteen degrees with respect to said perpendicular axis of said surface of said earth, said system comprising:

a bottom hole assembly positioned at a bottommost end of a drill string, said bottom hole assembly comprises one or more components comprising one or more of a bit, bit sub, drill collars, heavyweight drill collars, heavy weight drill pipes, stabilizers, reamers, shocks, hole openers, downhole motor, rotary steerable system, directional drilling while measurement equipment, steering unit, near bit inclination, non-magnetic drill collar, said bottom hole assembly being connected to a drill pipe portion of said drill pipe, providing that said drill pipe portion comprises drill pipe, coiled tubing, or heavyweight drill pipe;

a mechanism positioned above a center point along an axis through said bottom hole assembly, said mechanism comprises rigid moveable members;

said mechanism allows relative movement rigid metal element slipping rotation a lower portion of said bottom hole assembly below said centerpoint in response to said drill bit sticking and starting.

The invention claimed is:

1. A downhole ratchet connectable in a drilling string to release torsional energy produced in said drilling string due to slip-stick during drilling of a wellbore with a PDC (polycrystalline diamond compact) drill bit, said drilling string extending from the surface to said PDC drill bit, a drive to produce rotational drilling force to rotate said PDC drill bit, said downhole ratchet comprising:

a first tubular and a second tubular, said first tubular and said second tubular being connectable into said drilling string;

a first gear mounted to rotate with said first tubular;

a second gear mounted to rotate with said second tubular; and a bias member that urges a gear engagement of said first gear with said second gear, said gear engagement between said first gear and said second gear is operable to connect said rotational drilling force through said first tubular and said second tubular to rotate said PDC drill bit, said gear engagement permitting sliding rotational contact between said first gear and said second gear in response to said slip-stick to release torsional energy in said drill string resulting from said slip-stick while drilling said wellbore with said PDC drill bit.

2. The downhole ratchet of claim 1, further comprising a rotating connection between said first tubular and said second tubular.

3. The downhole ratchet of claim 2, wherein said rotating connection is operable to support a weight of said drilling string below a downhole position of said downhole ratchet.

4. The downhole ratchet of claim 2, wherein said rotating connection comprises an outer tubular portion and an inner tubular portion, said outer tubular portion defining a first groove on an interior surface, said inner tubular portion defining a second groove, and a bearing inserted into said first groove and said second groove.

5. The downhole ratchet of claim 1, further comprising said first gear being slidingly mounted with respect to said first tubular.

6. The downhole ratchet of claim 1, wherein after said torsional energy is released from said drilling string said first gear and said second gear comprise surfaces that lock together again to pass said rotational drilling force through said first tubular and said second tubular to rotate said PDC drill bit.

7. The downhole ratchet of claim 1, wherein said downhole ratchet is operable without a downhole rotational speed sensor.

8. A downhole ratchet connectable in a drilling string to release torsional energy produced in said drilling string due to slip-stick during drilling of a wellbore with a PDC (polycrystalline diamond compact) drill bit, said drilling string extending from the surface to said PDC drill bit, a drive to produce rotational drilling force to rotate said PDC drill bit, said downhole ratchet being connectable between a first tubular and a second tubular in said drilling string, said downhole ratchet comprising:

a first tubular and a second tubular, said first tubular and said second tubular being connectable into said drilling string;

a first gear mounted to rotate with said first tubular;

a second gear mounted to rotate with said second tubular;

gear teeth on said first gear and said second gear comprising surfaces that are angled with respect to an axis through said first tubular and said second tubular to permit rotationally sliding engagement of said gear teeth in response to said slip-stick, said gear teeth on said first gear and said second gear being arranged to otherwise lock together to allow said rotational drilling force to rotate said PDC drill bit; and a rotating connection that permits rotation between said first tubular and said second tubular to release said torsional energy produced in said drilling string by said slip-stick.

9. The downhole ratchet of claim 8, further comprising a bias member that urges gear engagement said first gear and said second gear into said rotationally sliding engagement in response to said slip-stick.

10. The downhole ratchet of claim 9, further comprising said first gear being slidingly mounted with respect to said first tubular.

11. The downhole ratchet of claim 8, further comprising said rotating connection comprises an outer tubular portion and an inner tubular portion, said outer tubular portion defining a first groove on an interior surface, said inner tubular portion defining a second groove, a bearing inserted into said first groove and said second groove, said rotating connection is operable to support a weight of said drilling string below a downhole position of said downhole ratchet in said drilling string.

12. The downhole ratchet of claim 8, wherein said downhole ratchet is operable without a downhole rotational speed sensor.

13. A method for releasing a torsional energy within a drilling string produced due to slip-stick while drilling a wellbore with a PDC (polycrystalline diamond compact) drill bit, said drilling string extending from the surface to said PDC (polycrystalline diamond compact) drill bit, said drilling string comprising a bottom hole assembly and a length of drill pipe longer than said bottom hole assembly, a drive to produce rotational drilling force to rotate said PDC drill bit for drilling said wellbore, said method comprising:

providing a first tubular and a second tubular that are connectable into said drilling string;

providing a first gear that rotates with said first tubular;

providing a second gear that rotates with said second tubular;

providing that said first gear is biased into contact with said second gear;

providing that said first gear and said second gear are operable to lock together to provide rotational drilling force to said PDC drill bit; and providing that said first gear and said second gear are responsive to slip-stick to slidingly rotate against each to thereby release said torsional energy in said drilling string produced due to said slip-stick while drilling said wellbore with said PDC bit.

14. The method of claim 13, further comprising connecting multiple instances of said first tubular, said second tubular, said first gear, and said second gear into said drilling string.

15. The method of claim 13, comprising inserting said first tubular, second tubular, first gear and second gear into said drill pipe at a position above a top of said bottom hole assembly.

16. The method of claim 13, comprising inserting said first tubular, second tubular, first gear and second gear into said drill pipe at a position within about ten drill pipes above a top of said bottom hole assembly.

17. The method of claim 16, comprising inserting said first tubular, second tubular, first gear and second gear into a position above a center point of said bottom hole assembly.

18. The method of claim 13 comprising utilizing software to determine a position for inserting said first tubular, second tubular, first gear and second gear into said drilling string.

19. The method of claim 13, comprising providing a rotatable connection between said first tubular and said second tubular that is operable to support a weight of said drilling string below second tubular.

20. The method of claim 13 wherein said first tubular, said second tubular, said first gear, and said second gear are operable to release said torsional energy from said drilling string without using a downhole rotational speed sensor.

* * * * *